United States Patent [19]

Ansted et al.

[11] 3,965,692

[45] June 29, 1976

[54] REFRIGERATION CONTROL CIRCUIT

[75] Inventors: Roger C. Ansted; Gerald L. Rodgers, both of San Antonio, Tex.

[73] Assignee: Friedrich Refrigerators Inc., San Antonio, Tex.

[22] Filed: Nov. 15, 1974

[21] Appl. No.: 524,131

[52] U.S. Cl. ..... 62/193; 62/234

[51] Int. Cl.[2] ..... F25D 21/08

[58] Field of Search ..... 62/156, 162, 158, 234, 62/276, 193

[56] References Cited

UNITED STATES PATENTS

| | | | |
|---|---|---|---|
| 2,199,426 | 5/1940 | Wolfert | 62/193 |
| 2,548,324 | 4/1951 | Smith | 62/234 X |
| 3,436,929 | 4/1969 | Harbour | 62/234 X |
| 3,439,511 | 4/1969 | Christman | 62/234 X |

*Primary Examiner*—William E. Wayner

*Attorney, Agent, or Firm*—Lane, Aitken, Dunner & Ziems

[57] ABSTRACT

The electrical control panel for a refrigeration unit using single or three phase power. The control portion has an oil pressure safety switch, defrost timer, temperature controls and perhaps a refrigerant pressure control in conjunction with the normal internal overload circuit breakers for the compressor. After operation of the refrigeration unit for a period of time, a defrost control device cuts off the compressor and turns on the electric defrost heaters. As the evaporator coils are defrosted, defrost thermostats open the defrost heater supply circuits. When the current sensing relay senses that all the defrost heaters have been shut off via the defrost thermostats, a time delay relay will return the refrigeration unit to the normal refrigeration cycle. The same current sensing relay will prevent false triggering by the oil pressure safety switch if the compressor's internal overload circuit breaker opens.

18 Claims, 1 Drawing Figure

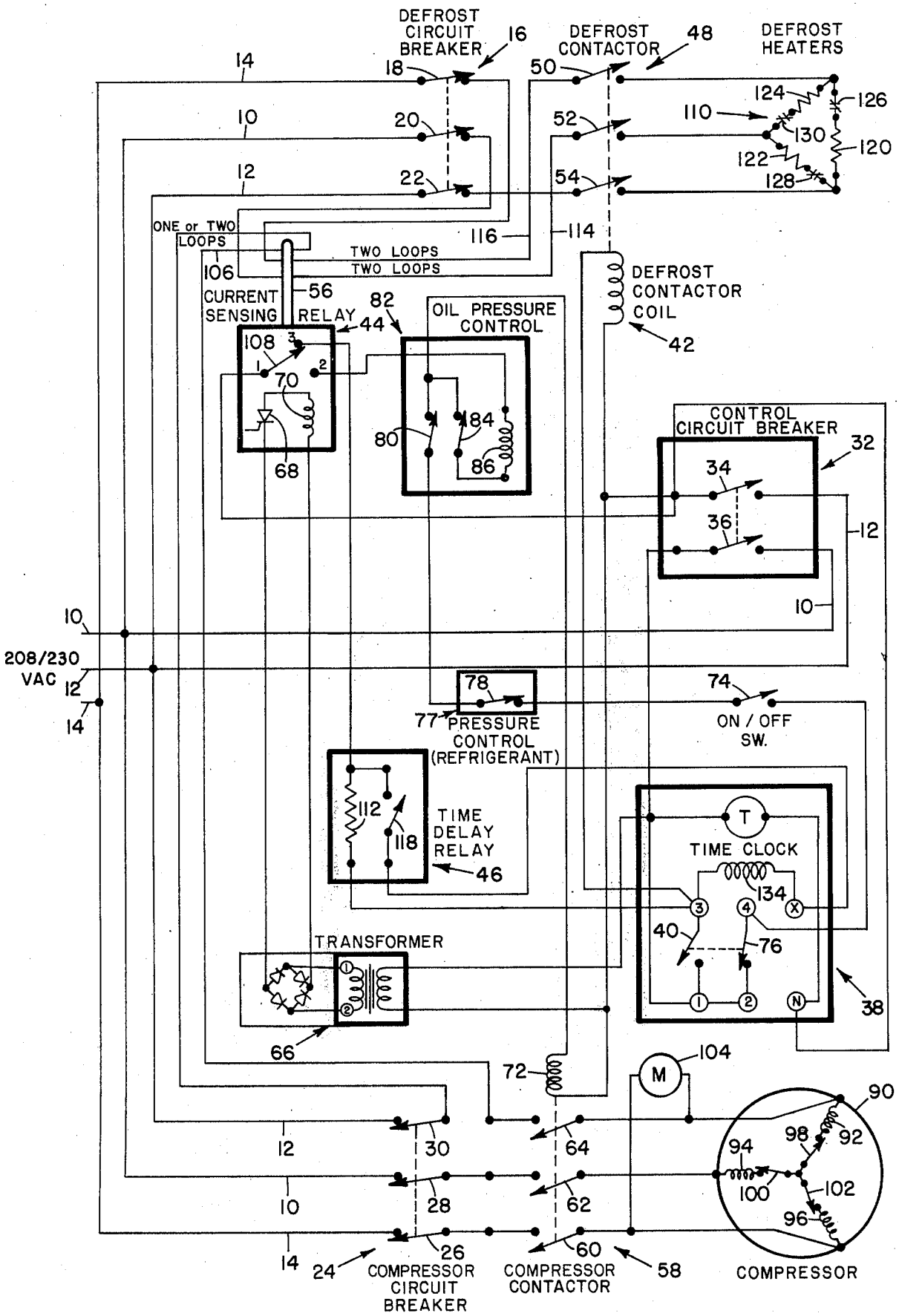
DEFROST CIRCUIT BREAKER
16
DEFROST CONTACTOR
48
DEFROST HEATERS
14
18
50
124
126
10
20
52
110
130
120
12
22
54
122
128
ONE or TWO LOOPS
116
114
106
TWO LOOPS
TWO LOOPS
DEFROST CONTACTOR COIL
42
CURRENT SENSING RELAY
56
82
44
OIL PRESSURE CONTROL
108
70
80
84
86
68
CONTROL CIRCUIT BREAKER
32
34
36
12
10
208/230 VAC
78
74
77
PRESSURE CONTROL (REFRIGERANT)
ON / OFF SW.
112
118
TIME DELAY RELAY
46
T
TIME CLOCK
134
40
76
38
TRANSFORMER
66
72
104
M
90
92
98
94
100
102
96
30
64
28
62
26
60
24
58
COMPRESSOR CIRCUIT BREAKER
COMPRESSOR CONTACTOR
COMPRESSOR

REFRIGERATION CONTROL CIRCUIT

BACKGROUND OF THE INVENTION

Prior to the present invention, manufacturers of refrigeration systems, such as the refrigerated display and storage systems for supermarkets, have been installing separate current sensing relays to perform the functions of protecting against nuisance tripping of the oil pressure safety switch and sensing current in the defrost circuit to determine when the defrost cycle should be terminated. When a control panel required both these separate functions to be performed, as many as three separate current sensing relays were required (one to protect against nuisance tripping of oil pressure safety switch and two for sensing current in a three phase defrost circuit).

If the oil pressure safety switch was not included on compressors equipped with oil pumps and the oil pressure dropped below a predetermined point, a failure of the compressor would likely occur. This could damage other parts of the refrigeration system. On the other hand, if a compressor was also equipped with internal overload circuit breakers and these tripped, the oil pressure safety switch would also trip unless it was protected against this nuisance tripping. Generally the internal overload circuit breakers will reset automatically; however, the oil pressure safety switch will not. Unless an oil pressure safety switch is protected against nuisance tripping the perishable contents of refrigerated space will spoil upon prolonged loss of refrigeration.

In recent years there has been increased demand for a means of minimizing defrost times and reducing the amount of defrost heat added to the refrigerated spaces for both energy conservation reasons and, in the case of refrigerated foods, quality reasons. In answer to these customer demands, thermostats are increasingly being used on individual evaporator coils that disconnect the defrost heaters once the coil's temperature has been raised high enough to melt the accumulated frost. However, the compressor control panel has to have its own means of determining when to end the defrost cycle and start the refrigeration cycle.

The means of accomplishing this function of triggering the end of the defrost cycle that has increasingly been asked for by users is the current sensing defrost termination. Prior to the present invention the normal method for accomplishing this function was the use of one current sensing relay on single phase defrost circuits and two current sensing relays on three phase. These relays were used only to sense the current in the defrost circuit.

The use of individual defrost heater thermostats and current sensing defrost termination saves both electrical energy as well as prolongs the shelf life of refrigerated and frozen foods stored in systems utilizing these controls. One additional benefit is the labor saved by not requiring any additional refrigeration line control hookups or field installed control wires with the corresponding cost savings.

As described in the literature from the manufacturer of the current sensing relay, there is a problem with getting proper phasing between the powering circuit for the current sensing relay and the direction of flow of the circuit being sensed by passing through the sensing loop of the relay. If the phasing was incorrect, the current sensing relay would not activate even though there was sufficient current in the wire passing through the sensing loop of the relay. Prior to this invention, this phasing problem could cause difficulty for the installers of equipment having this type of current sensing relay.

Though it is uncommon, the internal overload circuit breakers for the compressor of a refrigeration unit may trip periodically. As soon as the compressor unit cools down the circuit breakers will close and normal operation of the refrigeration unit would resume if the oil pressure control switch has not opened; however, in most refrigeration units the oil pressure will have decreased to such an extent that unless protected against nuisance tripping the oil pressure control switch will have opened, thereby preventing the continuation of the refrigeration upon closing of the internal overload circuit breakers for the compressor. The present invention is designed to remove power from the oil pressure control switch if no current is flowing through the compressor and thus prevent nuisance tripping of the oil pressure control. This is accomplished through the current sensing relay which provides the additional function of triggering the time delay relay once the defrost cycle has been completed.

By using the present control circuit several different refrigeration units can be operated by the same controls. The same compressor may be supplying refrigerant to a number of refrigeration units with a separate defrost heater located in each unit. This would minimize the amount of controls that would be necessary and reduce costs in a facility such as a supermarket.

SUMMARY OF THE INVENTION

Therefore, it is an object of the present invention to provide a control system for a refrigeration system.

It is another object of the present invention to provide a means for preventing the nuisance tripping of the oil pressure safety switch which could result in extensive damage to the product contained in the refrigerated space.

It is another object of the present invention to utilize one current sensing relay on single and three phase defrost circuits to tell when the defrost cycle can be terminated and returned to the refrigeration cycle.

It is another object of the present invention to perform both the function of preventing nuisance tripping of the oil pressure safety switch as well as the function of determining when the defrost cycle should be terminated.

It is even another object of this invention to provide a means of powering a current sensing relay so that the phasing between the power source and the circuit being sensed is no longer a problem in the operation of the current sensing relay.

BRIEF DESCRIPTION OF THE DRAWING

The drawing is an electrical schematic of a typical electrical control panel of a refrigeration system utilizing the present invention while employing a three phase power source.

DESCRIPTION OF THE PREFERRED EMBODIMENT

The drawing represents a schematic of a typical electrical control panel. There are many variations which although not shown are also included in this invention. Some of the possible variations include the possible deletion of circuit breakers, the adding of a terminal strip, having different defrost initiation devices, having different types of current sensing relays, combining of components such as the time clock and defrost voltages, frequencies, and phases.

Referring now to the drawing in conjunction with the following description, three phase power ranging between 208 to 230 volts AC is connected to the control circuit shown in the figure by power lines 10, 12 and 14. The power lines 10, 12 and 14 are connected directly to the defrost circuit breaker 16 and gang switches 18, 20 and 22.

Simultaneously the power lines 10, 12 and 14 feed to compressor circuit breaker 24 and gang switches 26, 28 and 30. Also, power lines 10 and 12 feed to the control circuit breaker 32.

To apply power to the control circuit shown in the figure, the control circuit breaker 32 is closed, thereby closing switches 34 and 36. Upon closing switch 36 power is fed to the time clock, represented generally by the reference numeral 38, by connecting power to terminal 1 and the timer motor represented by the letter T. Terminal 1 of the time clock 38 is connected to the normally open side of switch 40.

Also, upon closing the control circuit breaker 32, switch 34 will close thereby connecting power to one side of the defrost contactor coil 42. As long as the control circuit breaker 32 remains closed one side of the defrost contactor coil 42 will have power applied thereto via switch 34. The compressor contactor coil 72 is also connected to switch 34 of the control circuit breaker 32 so that after closing of the circuit breaker 32 power is continually supplied to one side of coil 72 of the compressor contactor 58. Also, power is applied to terminal 1 of current sensing relay 44. Simultaneously power is also applied to the N terminal of time clock 38. Internally within the time clock 38 terminal N connects to the timer motor T, thereby starting operation of the time clock.

Before proceeding with a detailed description of the operation of the control circuit, it should be realized that from the defrost circuit breaker 16 power lines 10, 12 and 14 are connected to the defrost contactor 48 with power line 14 connecting through gang switch 18 to gang switch 50, power line 10 connecting through gang switch 20 to gang switch 52, and power line 12 connecting through gang switch 22 to gang switch 54. The connections between gang switches 18 and 20 to gang switches 50 and 52, respectively, are looped through the current sensing loop 56 of the current sensing relay 44. Each of the previously mentioned leads that extend through the current sensing loop 56 should be looped approximately two times (depending on the amount of current flowing through the wire) and should be wound in opposing directions so that the current sensing relay 44 will operate without the effect created by the current of one lead canceling out the effect by the current of the other lead when defrost heater thermostats 126 and 128 have opened. This configuration eliminates the need for two relays, each sensing a different wire.

Many different types of current sensing relays 44 may be used but in the preferred embodiment of the present invention the inventor has used the CSR-1 current sensing relay by Robertshaw Controls Company, Grayson Division located in Long Beach, Calif. All of the internal circuitry for the current sensing relay 44 has not been shown in the figure. However, because the current sensing relay 44 does use a silicon controlled rectifier as its basic triggering element, it is necessary that the wave form powering the coil 70 be AC power or rectified AC power with no filtering so that the silicon control rectifier will turn off and then remain off as the current passing through the sensing loop 56 drops below a given level. The reason for using full wave rectification in our invention rather than half wave rectification or AC power is that if the powering circuit and the pulse generated by the current passing through the sensing loop 56 used to trigger the silicon controlled rectifier, as might be the case with AC or half wave rectified AC, the silicon controlled rectifier would not be turned on. By using full wave rectification phasing is no longer a problem.

Also, compressor contactor 58 and the respective switches connect to the compressor circuit breaker 24. Power line 14 connects through gang switch 26 directly to compressor contactor switch 60. Power line 10 connects through gang switch 28 directly to compressor contactor switch 62. However, power line 12 which connects through gang switch 30 loops two times through the current sensing loop 56 of current sensing relay 44 before connecting to compressor contactor switch 64.

From gang switches 34 and 36 of the control circuit breaker 32 is connected a transformer 66 that supplies power to the current sensing relay 44. Though not shown in detail the transformer 66 has a full wave rectified bridge so that the output therefrom will be approximately 24 volts of full wave rectified voltage, with terminal 1 being positive with respect to terminal 2. The voltage seen by coil 70 and silicon control rectifier 68 will be an oscillating DC voltage. This type of voltage wave form will provide the low deactivating current for the silicon controlled rectifier contained in the current sensing relay 44.

Starting now with the normal operation of the control circuit shown in the figure, the control circuit breaker 32 has been closed thereby closing switches 34 and 36. The on/off switch 74, which is a single pole, single throw switch, is manually closed. Power to the on/off switch 74 is supplied through time clock 38 via terminal 4 and normally closed switch 76 contained therein. From normally closed switch 76, power from switch 36 of the control circuit breaker 32 connects through terminal 1 and 2 of the time clock 36. Power feeds through the refrigerant pressure control switch 78 to the normally closed wiper arm 80 of the oil pressure control switch 82. Normally closed wiper arm 84, which opens on raising compressor oil pressure, is in series connection with heater coil 86 of oil pressure control 82. As oil pressure control heater coil 86 is powered it in turn heats a thermally responsive element (not shown) to move and hold wiper arm 80 in the open position. It is only upon continued loss of oil pressure that power is supplied long enough through coil 86 that wiper arm 80 opens.

Refrigerant pressure control 77 monitors the refrigerant pressure at the suction side of compressor 90. As the refrigerated space warms this sensed pressure will rise in accordance to a precise relationship between temperature and pressure. When the space warms to a predetermined limit and the sensed pressure rises to the corresponding pressure the refrigerant pressure control switch 78 closes which in turn allows compressor 90 to run. When the space has been cooled to a predetermined limit and the senses pressure falls to the corresponding pressure the refrigerant control switch 78 opens stopping compressor 90. While it is common practice to use a refrigerant pressure control such as 77 to initiate turning the compressor on and off as described, other methods may be used. As an example, an appropriate air sensing thermostat may be placed within the refrigerated space and its switch inserted in place of refrigerant pressure control switch 78.

When starting the refrigeration unit the refrigerant pressure control switch 78 will be closed. Oil pressure control switch 80 will remain closed unless the oil pressure drops below a predetermined point for a specified time while power is being supplied to coil 86. Through the oil pressure control 82 and wiper arm 80, power is connected to the compressor contactor coil 72. By energization of the compressor contactor coil 72, the compressor contactor 58 and switches 60, 62 and 64 will be closed simultaneously. By the closing of compressor contactor switches 60, 62 and 64 power will be supplied to the compressor 90.

The compressor 90 may be a conventional type having a Y-type motor with winding 92, 94 and 96 and internal overload circuit breakers 98, 100 and 102 are connected to operate simultaneously so that if an individual winding overheats the entire compressor 90 is disconnected from the circuit. After the temperature inside of the compressor 90 has decreased, the internal overload circuit breakers 98, 100 and 102 will again close, connecting the compressor back to the source of power. A fan motor 104, which is connected between any two of the leads for the compressor 90, will move the ambient air over the condenser coils (not shown) plus providing any cooling that may be necessary for the compressor 90. For the purposes of the present drawing, only one fan motor 104 has been shown. It is quite common for two or more fans to be utilized or none at all.

As long as the time clock 38 calls for the compressor 90 to run (as will be described in more detail subsequently) and the refrigerant pressure control switch 78 is closed indicating that more refrigeration is needed, the compressor 90 will continue to operate. Any time that the compressor 90 is running, the oil pressure control switch 80 should be in the position indicated in the figure. In the present invention power is supplied to coil 86 via the current sensing relay 44. Since the compressor 90 is running, a current will be flowing through wire 106 in the current sensing loop 56. This current flow will trigger silicon control rectifier 68 thereby allowing current to flow through coil 70. Current flowing through coil 70 will cause switch 108 to move from terminal 3 to terminal 2 of the current sensing relay 44. The heater coil 86 of the oil pressure ocontrol 82 is connected to terminal 2 of current sensing relay 44 and is therefore energized. As described earlier, if the oil pressure is below a predetermined point for a specified amount of time, coil 86 will be powered through the then closed wiper 84 and the heat from the coil 86 will open the wiper arm 80. If the oil pressure control switch 80 ever trips it has to be manually reset.

One of the key points of the present invention is to prevent nuisance tripping of the oil pressure control by disconnecting the oil pressure control heater 86 from power when current is not flowing through the compressor 90. This function is performed by switch 108 of the current sensing relay 44 that senses current through wire 106 which goes to the compressor 90. As long as current is flowing through wire 106, switch 108 will connect terminal 1 to terminal 2 of current sensing relay 44. If no current is flowing in wire 106, switch 108 will connect terminal 1 to terminal 3.

The previously discussed portion applies to the compressor 90 and the cooling aspect of the control circuit shown in the figure. After a predetermined amount of time of operation the time clock 38 will actuate the defrost cycle and, simultaneously, terminate the refrigeration cycle. This is accomplished by opening switch 76 of time clock 38 and closing switch 40. When switch 76 is open, power is removed from the compressor contactor coil 72, thereby opening switches 60, 62 and 64 of the compressor contactor 58 which disconnects the compressor 90 from power. With the closing of switch 40, power is now supplied to the defrost contactor coil 42 which actuates the defrost contactor 48 and closes switches 50, 52 and 54, thereby applying power to the defrost heaters 110. Within milliseconds after time clock 38 has opened switch 76 and closed switch 40, switch 108 of current sensing relay 44 will move from terminal 2 to terminal 3, thereby indicating no current is flowing through the sensing loop 56. At that point in time the heater resistor 112 of the time delay relay 46 will begin current flowing therethrough. A very short time later (probably milliseconds) the defrost contactor coil 42 has moved switches 50, 52 and 54 to the closed position, thereby connecting the defrost circuit 110 to the source of power. Since wires 114 and 116 loop through the current sensing loop 56 of the current sensing relay 44, switch 108 will move from terminal 3 back to terminal 2. Therefore, the heater resistor 112 of the time delay relay 46 will only be energized for a very short period of time, probably a few milliseconds. This is not enough time to close switch 118 of the time delay relay 46. Coil 86 of the oil pressure control 82 is disconnected from power during the defrost cycle when switch 76 is opened at the start of the defrost cycle.

Referring back to the defrost circuit 110 they comprise a delta configuration with each leg of the delta configuration having a resistance heater 120, 122 or 124 and their respective individual thermostat 126, 128 and 130. As current flows through the resistance heaters 120, 122 and 124 of the defrost circuit 110, the temperature of the evaporator coil (not shown) inside of the refrigeration unit begins to rise. As the temperature of the evaporator coil inside of the refrigeration unit reaches a predetermined point (approximately 70°F.) the individual thermostats 126, 128 and 130 will begin to open. Once the last of the three thermostats 126, 129 and 130 has opened, current will no longer be flowing through the current sensing loop 56 of current sensing relay 44. Since current is no longer flowing through the current sensing loop 56, switch 108 will move from terminal 2 to terminal 3 of current sensing relay 44 thereby applying power to heater resistor 112 of time delay relay 46. After a predetermined amount of time (approximately 45 seconds) switch 118 of time delay relay 46 will close, thereby connecting power to terminal X of time clock 38. Upon connecting terminal X of time clock 38 to power, coil 134 will move switches 40 and 76 back to their normal position thereby terminating the defrost cycle and again resuming the refrigeration cycle.

The dual functions of the current sensing relay 44 are not dependent on each other. The relay 44 could be used to just protect the oil pressure control switch 82 from nuisance tripping or used to just sense when to terminate the defrost cycle. This invention shows that one current sensing relay 44 can be used to both prevent nuisance tripping of the oil pressure control switch 82 and to terminate defrost for either single or three phase defrost circuits. This invention also shows that one current sensing relay can be used to determine when all the defrost heaters in a three phase defrost circuit have been turned off so that the defrost cycle can be terminated at that point.

All of the components used in the present invention are standard components that may be purchased from suppliers. In the preferred embodiment the components used are as follows:

TABLE

| COMPONENT TITLE | COMPONENT NUMBER | MANUFACTURER'S DESCRIPTION |
|---|---|---|
| Control Circuit Breaker | 32 | Square D QOU 220 |
| Time Clock | 38 | Paragon 8145-20B |
| Current Sensing Relay | 44 | Robertshaw CSR-1 |
| Time Delay Relay | 46 | Texas Instruments 6000A4 |
| Defrost Contactor | 48 | GE CR153DA053DSA |
| Transformer | 66 | Basler BE14186-001 |
| Compressor Contactor | 58 | GE CR153B068EZA |
| Oil pressure Control Switch | 82 | PENN P45 NCA |
| Pressure Control Switch | 78 | Ranco 12-4057 |
| Compressor | 90 | Copeland MRB1-0500-TFC |
| Motor | 104 | GE 5KCP39KG8103BS |

We claim:

1. Control circuitry for a refrigeration unit comprising:

a source of power;

control switches for turning on said source of power;

compressor means connected to said source of power, said compressor means pressurizing a refrigerant for cooling said refrigeration unit;

defrost means connected to said source of power for defrosting said refrigeration unit;

means for periodically disconnecting said compressor means from said source of power and connecting said defrost means to said source of power;

means for sensing current flow through said defrost means and said compressor means, said current sensing means actuating said disconnecting means upon completion of defrost to reconnect said compressor means to said source of power and to disconnect said defrost means from said source of power; and oil pressure control means associated with said compressor means and connected to said source of power for terminating power to said compressor means if oil pressure is reduced below a predetermined point for a specified period of time.

2. The control circuitry of claim 1 further comprising delay means for preventing the reconnection of said compressor means to said source of power until all current flow through said defrost means has terminated.

3. The control circuitry of claim 1 wherein said source of power is common three phase power, said control circuitry further including transformer means for providing rectified power to operate said current sensing means.

4. The control circuitry of claim 3 wherein said compressor means has three phase windings with each phase being connected through commonly operated internal circuit breakers, said current sensing means sensing one phase of said three phases to determine if current is flowing in said compressor means.

5. The control circuitry of claim 3 wherein said defrost means has three phase defrost heaters each with independent thermostats, said current sensing means sensing two of said three phases to determine if current is flowing in said defrost means.

6. The control circuitry of claim 1 wherein said defrost means and compressor means are connected and disconnected to said source of power by solenoid operated gang switches.

7. The control circuitry of claim 1 wherein said current sensing means is a sensing relay that prevents nuisance trips of said oil pressure control means be disconnecting said oil pressure control means with said source of power in response to the disconnecting of said compressor means and said defrost means with said source of power.

8. Control circuitry for a refrigeration unit comprising:

a source of power;

control switches for turning on said source of power;

compressor means connected to said source of power, said compressor means pressurizing a refrigerant for cooling said refrigeration unit;

defrost means connected to said source of power for defrosting said refrigeration unit;

means for periodically disconnecting said compressor means from said source of power and connecting said defrost means to said source of power;

means for sensing current flow through said defrost means, said current sensing means actuating said disconnecting means upon completion of defrost to reconnect said compressor means to said source of power and to disconnect said defrost means from said source of power; and delay means for preventing the reconnection of said compressor means to said source of power until all current flow through said defrost means has terminated.

9. The control circuitry of claim 8 wherein said source of power is common three phase power, said control circuitry further including transformer means for providing rectified power to operate said current sensing means.

10. The control circuitry of claim 9 wherein said compressor means has three phase windings with each phase being connected through commonly operated internal circuit breakers, said current sensing means sensing one phase of said three phases to determine if current is flowing in said compressor means.

11. The control circuitry of claim 9 wherein said defrost means has three phase defrost heaters each with independent thermostats, said current sensing means sensing two of said three phases to determine if current is flowing in said defrost means.

12. The control circuitry of claim 8 wherein said defrost means and compressor means are connected and disconnected to said source of power by solenoid operated gang switches.

13. The control circuitry of claim 8 wherein said power source supplies three phase power to said compressor means and said defrost means, wherein said current sensing means is a single current sensing relay that prevents nuisance trips of said oil pressure control means by disconnecting said oil pressure control means on loss of power to said compressor means and actuating said disconnecting means upon completion of defrost and wherein said defrost means has three independently controlled phases.

14. Control circuitry for a refrigeration unit comprising:

a three phase power source;

control switches for turning on said power source;

compressor means normally actuated by said power source for pressurizing a refrigerant for cooling said refrigeration unit;

defrost means for heating the evaporator coil of said refrigeration unit;

first means including a timer responsive to a predetermined time interval after actuation of said compressor means from said power source and connecting said defrost means to said power source to actuate said defrost means;

second means responsive to a predetermined amount of heating by said defrost means for disconnecting said defrost means from said power source to deactuate said defrost means and connecting said compressor means to said power source to actuate said compressor; and transformer means for providing rectified power to operate said second means.

15. The control circuitry of claim 14 wherein said compressor means has three phase windings with each phase being connected through commonly operated internal circuit breakers, said second means sensing one phase of said three phases to determine if current is flowing in said compressor means.

16. The control circuitry of claim 14 wherein said defrost means has three phase defrost heaters each with independent thermostats, said second means sensing two of said three phases to determine if current is flowing in said defrost means.

17. Control circuitry for a refrigeration unit comprising:

a source of power;

control switches for turning on said source of power;

compressor means normally actuated by said source of power for pressurizing a refrigerant for cooling said refrigeration unit;

defrost means for heating the evaporator coil of said refrigeration unit;

first means including a timer responsive to a predetermined time interval after actuation of said compressor means for disconnecting said compressor means from said source of power and connecting said defrost means to said source of power to actuate said defrost means;

second means responsive to a predetermined amount of heating by said defrost means for disconnecting said defrost means from said source of power to deactuate said defrost means and connecting said compressor means to said source of power to actuate said compressor; and solenoid operated gang switches for connecting and disconnecting said defrost means and said compressor means to said source of power.

18. Control circuitry for a refrigeration unit comprising:

a source of power;

control switches for turning on said source of power;

compressor means normally actuated by said source of power for pressurizing a refrigerant for cooling said refrigeration unit;

defrost means for heating the evaporator coil of said refrigeration unit;

first means including a timer responsive to a predetermined time interval after actuation of said compressor means for disconnecting said compressor means from said source of power and connecting said defrost means to said source of power to actuate said defrost means; and a sensing relay responsive to a predetermined amount of heating by said defrost means for disconnecting said defrost means from said source of power to deactuate said defrost means and connecting said compressor means to said source of power to actuate said compressor, said sensing relay disconnecting said oil pressure control means with said source of power in response to the disconnecting of said compressor means and said defrost means with said source of power to prevent nuisance trips of said oil pressure control means.

* * * * *